US005951501A

United States Patent [19]

Griner

[11] Patent Number: 5,951,501

[45] Date of Patent: Sep. 14, 1999

[54] PULSATING MUSCLE MASSAGING DEVICE

[75] Inventor: Thomas Edward Griner, Los Angeles, Calif.

[73] Assignee: Point Financial Associates, Lake Tahoe, Nev.

[21] Appl. No.: 08/771,584

[22] Filed: Dec. 20, 1996

[51] Int. Cl.[6] ..... A61H 23/00

[52] U.S. Cl. ..... 601/108; 601/107; 601/101; 601/97

[58] Field of Search ..... 601/107, 108, 601/111, 89, 97, 101, 103

[56] References Cited

U.S. PATENT DOCUMENTS 4,730,605 3/1988 Noble et al. ..... 601/110
5,167,226 12/1992 Laroche et al. ..... 128/55
5,447,491 9/1995 Bellandi ..... 601/112
5,626,555 5/1997 Di Blasi et al. ..... 601/98

*Primary Examiner*—Robert A. Hafer
*Assistant Examiner*—Benjamin K. Koo
*Attorney, Agent, or Firm*—Oppenheimer Wolff & Donnelly LLP

[57] ABSTRACT

A pulsating muscle massaging device having motor activated cams-adapted to produce a rapid stroke cycle with long dwell between strokes and transmit the same to a plunger terminating in a resilient massaging tip whereby said tip moves rapidly back and forth to massage one's muscle.

13 Claims, 4 Drawing Sheets

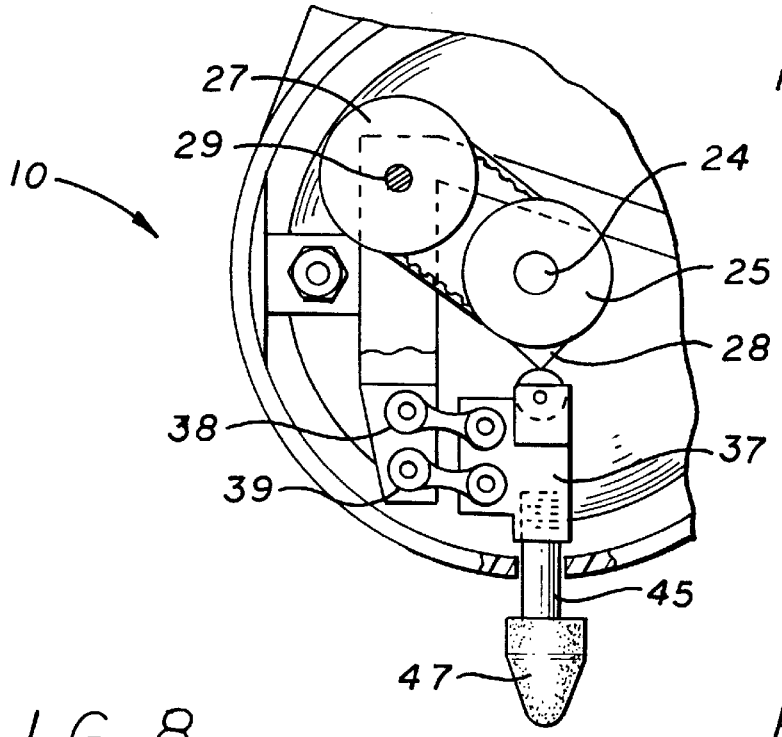
FIG. 4
FIG. 8
PRIOR ART
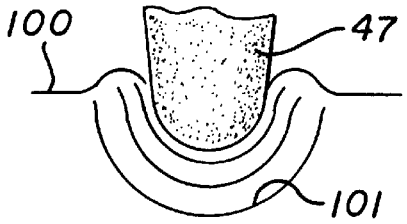
FIG. 9
PRIOR ART
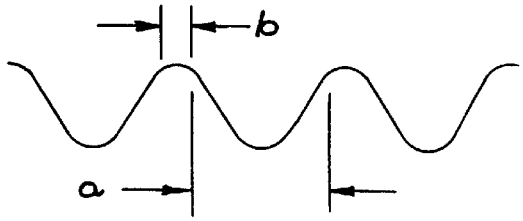
FIG. 10
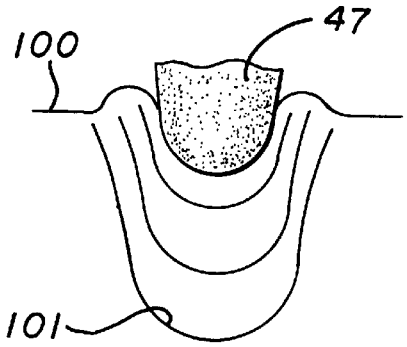
FIG. 11
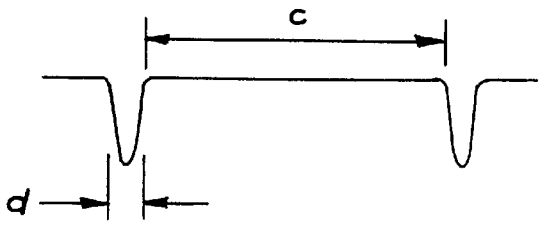

FIG. 5
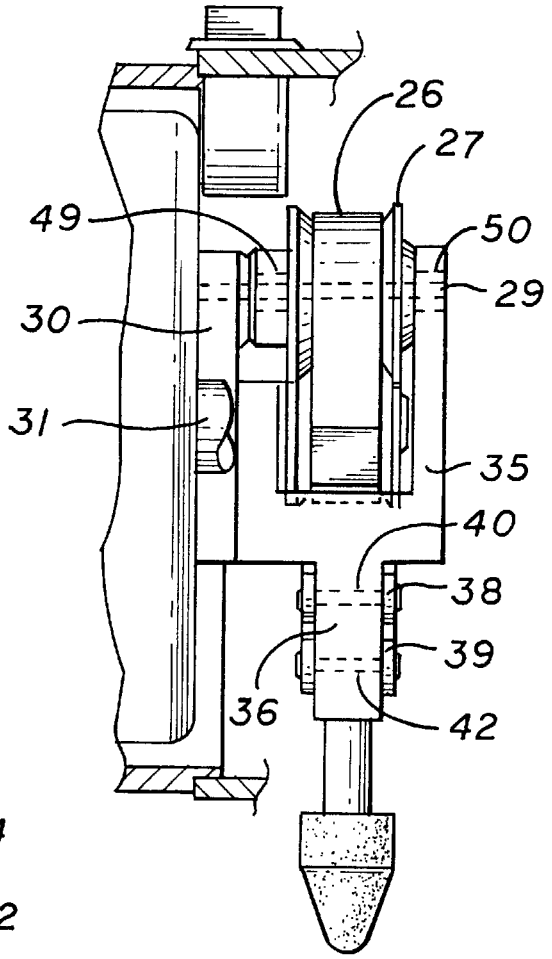
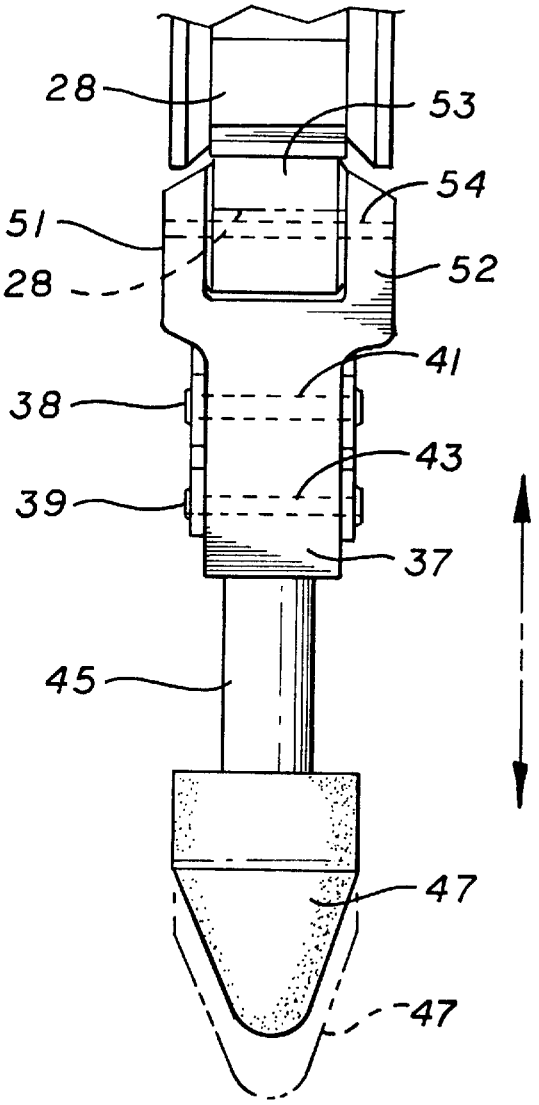
FIG. 6

PULSATING MUSCLE MASSAGING DEVICE

BACKGROUND OF THE INVENTION

1. Field of the Invention

The invention relates to pulsating devices; and, more particularly to a pulsating muscle massaging device.

2. Description of the Prior Art

Many people suffer form various ailments, such as allergies, headaches, or arthritis. Some people endure constant pain of backaches, knee problems, or Temporomandibular Joint Syndrome. Others are affected by asthma, high blood pressure, or digestive disorders.

A book entitled *What's Really Wrong With You*?, by Thomas Griner, published by Avery Publishing Group, presents a revolutionary look at how muscles can affect your health. Muscle comprises more than half of the body's mass. Yet this major part of the anatomy has been consistently overlooked in traditional diagnoses of common ailments. That is, until now. In my book, I reveal how unhealthy muscles can cause a broad range of disorders, from back pain to bronchitis. I show how these problems can be successfully overcome without the use of drugs or surgery.

Divided into three parts, my book is a guide to understanding many common ailments and how they can be corrected. In Part One, I discuss how muscles become unhealthy. In Part Two, I show the physiological role of muscle in many illnesses. And to promote muscle health, in Part Three, I explain how you can perform body-friendly exercises. I also tell you how to apply my own muscle-massage technique, which has proven effective for patients with varying disorders.

One of the techniques I suggest in my book is concentrated controlled tapping of the muscle. Such percussion must be very short and very fast. There is a fraction-of-a-second delay in the stretch-reflex response, and because of this one can use considerably more pressure with percussing than with stroking. This allows one to work on deep tissues that one could not otherwise reach.

Like a stroking technique, such percussive technique takes a long time to perfect. There is a need for a machine to carry out such techniques. Such a machine should percuss faster than is humanly possible. It should not mindlessly thump. Instead, it should produce a thrust that will generate strong biological nerve response. With other prior art massagers, even those with a percussive movement, each thrust takes too long, and there are too many thrusts per second. This overloads the nerve circuits and produces a jumbled, tingling response which does nothing to release spasm. There is a need for a percussive machine that provides fewer thrusts per second, each thrust being of extremely short duration. Such a machine should be designed to be compatible with the biological recovery period of the nerve circuits, so that one's nervous system can integrate the stimulation.

SUMMARY OF THE INVENTION

It is an object of this invention to provide a pulsating muscle massaging device for massaging muscles which percusses quickly with very short strokes to a predetermined depth.

It is a further object of this invention to carry out the foregoing objects wherein there is a fraction of a second delay in the stretch-reflex response when treating muscles.

These and other objects are preferably accomplished by providing a device having motor activated camming means adapted to produce a rapid stroke cycle with long dwell between strokes and transmit the same to a plunger terminating in a resilient massaging tip whereby said tip moves rapidly back and forth to massage one's muscle.

BRIEF DESCRIPTION OF THE DRAWING

FIG. 4 is a detailed view, partly in section, of a portion of the view of FIG. 3 illustrating operation of the devices of the invention;

FIG. 5 is a view taken along lines 5—5 of FIG. 3;

FIG. 6 is a view taken along lines 6—6 of FIG. 3;

FIG. 8 is an illustration of an application to a muscle using a prior art massaging device;

FIG. 9 is a graphic illustration of the effect of the prior art technique in FIG. 5;

FIG. 10 is an illustration of an application to a muscle using the device of the invention; and FIG. 11 is a graphic illustration of the effect of the technique of FIG. 10.

DESCRIPTION OF THE PREFERRED EMBODIMENT

Figure 1:
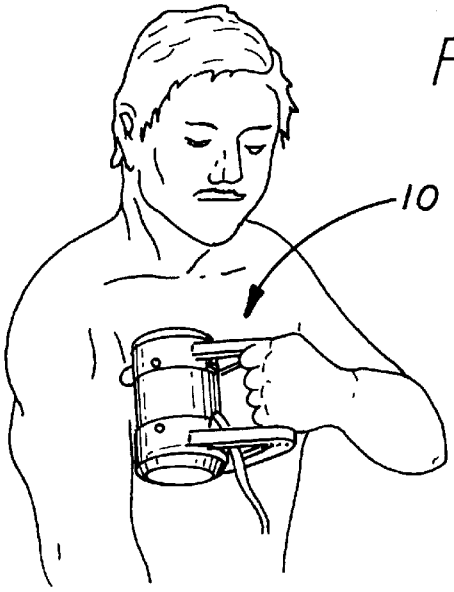
FIG. 1 is a perspective view illustrating the operation of the device of my invention.
Figure 2:
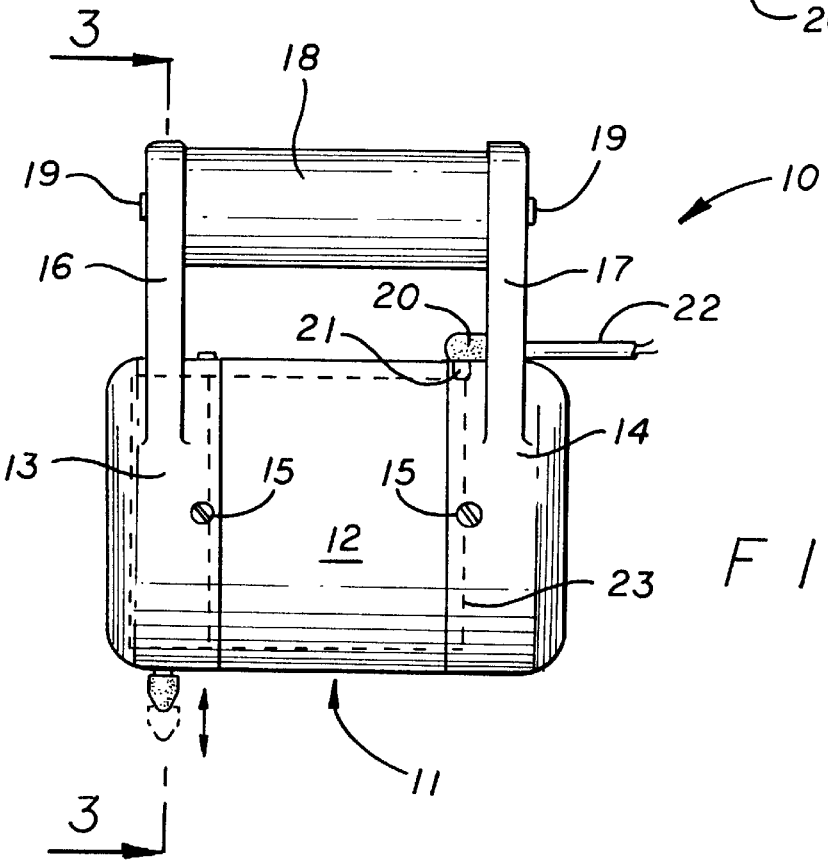
FIG. 2 is an elevational view of the device alone of FIG. 1.

Referring now to FIG. 1 of the drawing, a person is shown using the holding device 10 of the invention in operative position massaging one of his muscles. As seen in FIG. 2, device 10 includes an outer housing 11 comprised of a main middle body portion 12, which may be cylindrical, closed off by end caps 13, 14 at opposite ends thereof. Caps 13, 14 are secured to portion 12 by suitable screws 15. Each end cap has a generally V-shaped integral handle support, as supports 16, 17, respectively (see also FIG. 1), supporting therebetween at each apex thereof a handle 18 which may be cylindrical. Suitable screws 19 or the like may be used to screw handle 18 to each support 16, 17.

A plug 20, which may removably snap into socket 21 shown in dotted lines in FIG. 2, may be provided coupled via electric conduit 22 to a suitable plug (not shown) for connecting the same to an electrical outlet (also not shown). Plug 20 is coupled via socket 21 to a motor 23, shown in dotted lines in FIG. 2, which may be any suitable motor such as a 1550 RPM, 1/30 HP, and any suitable dimensions, such as 3.3" in diameter and 3" in length. Thus, any suitable motor may be used such as a synchronous drive motor operating between 1500 to 1800 RPMs.

Figure 3:
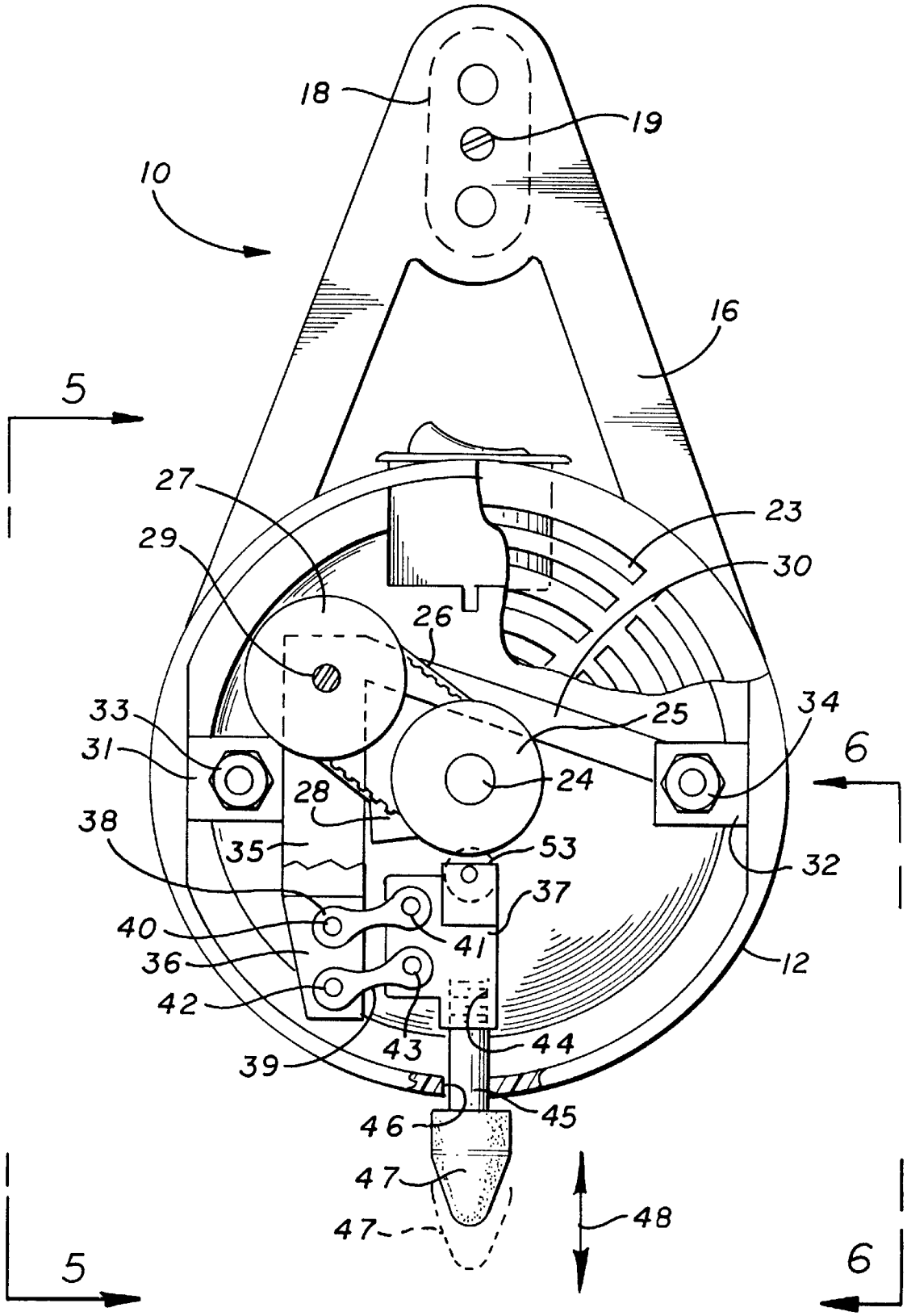
FIG. 3 is a view, partly in section, taken along lines 3—3 of FIG. 2.

As seen in FIG. 3, motor 23 has a motor shaft 24 which is coupled to a drive pulley 25. Drive pulley 25 is rotated by shaft 24 and may have teeth thereon, such as 12 teeth, as is well known in the art, engaging toothed belt 26 (such as a 23 tooth belt with a 4.8" pitch length). Belt 26 in turn engages the teeth of an idler pulley 27, which may also have 12 teeth therein. As seen in FIG. 4, belt 26 has a ramp 28 fixed thereto for reasons to be discussed.

Idler pulley 27 is mounted via pin 29, to a bracket 30 (see also FIG. 5). Bracket 30 (FIG. 3) is mounted to housing portion 12 via bracket flanges 31, 32, integral with bracket 30 and secured to the inner wall of housing portion 12 by suitable nuts and bolts 33, 34, respectively.

A plunger support bracket 35, which is Y-shaped in cross-section, (see also FIG. 5) is also secured via shaft 29 on the other side of pulley 27 having an integral downwardly extension portion 36. A plunger body 37 (FIG. 6) is coupled to extension portion 36 by a pair of links 38, 39. Link 38 is pivotally connected, via pivot pin 40, at one end to extension portion 36 and at the end, via pivot pin 41, to plunger body 37. Link 39, spaced from link 38 and below the same, is coupled at one end via pivot pin 42 to extension portion 36 and at the other end via pivot pin 43 to plunger body 37.

A threaded socket 44 is provided at the lower end of plunger body 37 receiving therein a threaded shaft or rod 45, which extends downwardly through a hole 46 in housing 12 terminating in a resilient applicator tip 47. As seen in FIG. 3, tip 47 is conically shaped and adapted to move up and down, as indicated by arrow 48 between the solid line and dotted line positions indicated.

If desired, bearings 49, 50 (see FIG. 5) may be provided in brackets 30, 35, respectively, so that shaft 29 can freely rotate therein.

As seen in FIG. 6, a pair of spaced brackets 51, 52 are provided on each side of the upper portion of plunger body 37. A bearing 53 is journalled therebetween for rotation on shaft 54. When pulley 25 is rotated, ramp 28 is adapted to abut against bearing 53 and move the plunger body 37 downwardly, and back upwardly, as indicated by the arrows in FIG. 6 thereby moving tip 47 as will be discussed. That is, plunger body 37, pivotally coupled to bracket 36 via links 38, 39, moves up and down with shaft 45 reciprocating in hole or opening 46 which assists in maintaining the linear vertical movement of shaft 45.

Figure 7:
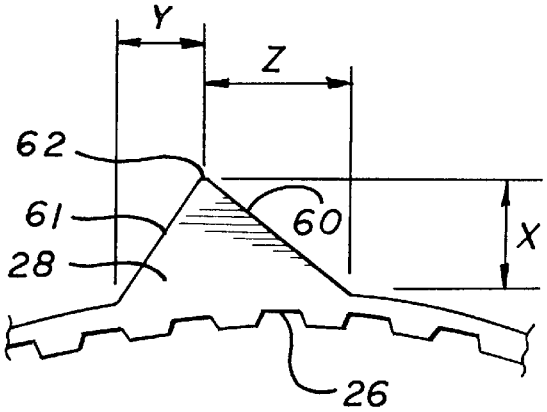
FIG. 7 is a detailed view of a portion of the belt alone of the device of FIGS. 1 to 6.

As seen in FIG. 7, ramp 28 has one longer sloped side 60 than the other side 61. This controls the depth of the stroke of tip 47 as bearing 53 rides up side 60 to tip 62. The spacing x may be about 0.280"; the spacing y may be about 0.200" and the spacing z may be about 0.300". Of course, these dimensions may vary.

Any suitable equipment may be used. Belt 26 may be a cogged timing belt with pulleys 25, 27 being conventional timing belt pulleys. Ramp 28 may be made of neoprene rubber. A fan (not shown) may be provided in housing 11 on the opposite side of shaft 24 rotated by motor 23 as is well known in the art. Motor 23 could be battery operated and such batteries could be rechargeable.

In operation, when motor 23 is activated, belt 26 turns about pulley 25 rotating pulley 27. When ramp 28 engages bearing 53, it moves it downwardly in rapid short strokes to the dotted line position in FIG. 6, links 38, 39 serving to return bearing 53 back to the solid line position. This of course moves tip 47 up and down as indicated by arrows 54.

FIG. 8 illustrates what takes place when one uses a crank driven pulsating device having a tip 47 that is used to massage one's muscles. Here, the tip 47 percusses down through skin line 100 forming a compression wave 101. Certain prior art devices, such as one producing the effect shown in FIG. 8, have too short a dwell time, e.g., 0.0065 seconds. This is illustrated graphically in FIG. 9 wherein a wave is created using a 1550 RPM crank driven motor. This produces a pulse duration a of about 0.0325 seconds. Dwell time is indicated at b. Such a slow speed produces little compression with a small depth of stimulation.

However, as seen in FIG. 10, and referring to FIG. 11, it can be seen that, using the cam driven device 10 of the invention, a 0.0705 second dwell time (c) for nerve processing and reset time produces a 0.0075 seconds pulse duration (d) due to the greater speed given more compression for greater depth of muscle stimulation.

Thus, using device 10, the user pulses his muscle as seen in FIG. 1, tip 47 coming down fast enough and far enough to create a compression wave as seen in FIG. 10.

Although the device 10 is shown in FIG. 1 as hand held, obviously it may be mounted on a support, or to a door jamb or the like, using suitable clamps, for securing the same and adjusting the elevation. It is this manner, a user could reach muscles not accessible without assistance.

It can be see that there is disclosed a device for applying percussive treatment to one's muscles which is cam driven and produces a rapid stroke cycle with long dwell in between. The tip 47 and shaft 45 is removable so other lengths may be substituted to vary the stroke length and thus control the intensity of the stroke. Tip 47 may be made of any suitable material, such as neoprene material.

It can be seen that there is disclosed a preferred embodiment of the invention. However, the scope of the invention should only be limited by the scope of the appended claims.

I claim:

1. A pulsating muscle massaging device comprising:

a main housing;

a motor mounted in said housing having a motor shaft coupled to a drive pulley rotatably mounted thereon;

an idler pulley spaced from said drive pulley rotatably mounted in said housing;

an endless toothed belt encircling said pulleys;

a plunger body mounted in said housing, said plunger body being pivotally mounted for reciprocal movement within said housing, and a shaft mounted to said plunger body extending out of an opening in said housing terminating in a resilient tip wherein the improvement comprising:

a first cam member integrally formed on said endless toothed belt and said first cam member is of a generally triangularly shaped ramp:

a second cam member mounted on said plunger, said second cam member being co-linear with said first cam member and said plunger, said plunger reciprocating when said first cam member engages said second cam member and being effective to create a percussion movement of said resilient tip.

2. In the device of claim 1 wherein said first cam member having a pair of angled sides terminating at an axis, one of said angled sides being longer than the other side.

3. In the device of claim 2 wherein said first cam member on said endless belt is located such that rapid stroke cycles of said cam member is separated by long dwell therebetween.

4. In the device of claim 1 wherein said resilient tip moves in a rapid, linear motion.

5. In the device of claim 1 wherein said shaft being movable within said opening when said plunger body reciprocates, the wall of said housing surrounding said shaft and restricting the movement of said shaft to linear movement within said opening.

6. In the device of claim 1 wherein said resilient tip being disposed outside of said housing.

7. In the device of claim 1 wherein the length of stroke of the said plunger is variable.

8. In the device of claim 1 wherein said main housing includes a central main body portion closed off by end caps at each end thereof, each of said end caps having a handle support integral therewith with a handle mounted therebetween spaced from said main body portion.

9. In the device of claim 1 wherein said motor is a 1550 RPM synchronous drive motor.

10. In the device of claim 9 wherein said motor is a synchronous drive motor between about 1550 to 1800 RPMs pulsing said plunger at about 15 times per second.

11. In the device of claim 1 wherein each of said pulleys are 12 tooth pulleys, said belt being a 23 tooth belt with a 4.8" pitch length.

12. In the device of claim 1 wherein said second cam member is a bearing rotatably mounted in said plunger body.

13. In the device of claim 1 wherein said plunger body is pivotally mounted within said housing by a bracket mounted to the interior wall of said housing, and a pair of spaced pivotally mounted links interconnecting said bracket to said plunger body.

* * * * *